US009370674B2

(12) United States Patent
Monk et al.

(10) Patent No.: US 9,370,674 B2
(45) Date of Patent: Jun. 21, 2016

(54) PLURAL LAYER, PLURAL-ACTION PROTECTIVE COATING FOR LIQUID FUEL CONTAINER

(71) Applicant: High Impact Technology, LLC, Tigard, OR (US)

(72) Inventors: Russell A. Monk, Salem, OR (US); Thomas S. Ohnstad, Salem, OR (US)

(73) Assignee: High Impact Technology, LLC, Tigard, OR (US)

( * ) Notice: Subject to any disclaimer, the term of this patent is extended or adjusted under 35 U.S.C. 154(b) by 610 days.

(21) Appl. No.: 13/689,718

(22) Filed: Nov. 29, 2012

(65) Prior Publication Data

US 2013/0140046 A1 Jun. 6, 2013

Related U.S. Application Data

(60) Provisional application No. 61/567,111, filed on Dec. 5, 2011.

(51) Int. Cl.

| | |
|---|---|
| ***A62C 3/06*** | (2006.01) |
| ***B65D 90/22*** | (2006.01) |
| ***B65D 90/06*** | (2006.01) |

(Continued)

(52) U.S. Cl.

CPC ..... *A62C 3/065* (2013.01); *B65D 90/06* (2013.01); *B65D 90/22* (2013.01); *F41H 5/0471* (2013.01); *F41H 5/0478* (2013.01); *A62C 2/065* (2013.01); *B65D 2590/026* (2013.01)

(58) Field of Classification Search

CPC ..... A62C 2/06; A62C 2/065; A62C 3/06; A62C 3/065; A62C 3/07; A62C 3/08; A62C 3/10; F41H 5/0471; F41H 5/0478; B65D 2590/02; B65D 2590/026; B65D 90/06; B65D 90/22

USPC ..... 169/48, 49, 62, 66

See application file for complete search history.

(56) References Cited

U.S. PATENT DOCUMENTS

| | | | |
|---|---|---|---|
| 1,463,498 | A | 7/1923 | Burgess |
| 1,548,441 | A | 8/1925 | Branovich |
| 2,365,940 | A | 12/1944 | Couse |

(Continued)

FOREIGN PATENT DOCUMENTS

| | | |
|---|---|---|
| GB | 2048163 | 12/1980 |

*Primary Examiner* — Christopher Kim

(74) *Attorney, Agent, or Firm* — Kolisch Hartwell, P.C.

(57) ABSTRACT

A plural-layer protective coating placeable adjacent the outside surface of a liquid fuel container. The coating, differentially in two, different embodiments, includes (a) a self-sealing, anti-fuel-leakage, elastomeric-response layer having an inside face disposable directly in contact with such a container's outside surface, and having an outside face spaced from its inside face, (b) an intumescence-response layer, absent in one principal embodiment, and present in the other, having an inside face, when present, disposed adjacent the outside face in the elastomeric-response layer, formed of an intumescence putty material, and having an outside face, and (c) a packetized, burst-reactive, flame-suppression layer including plural, side-by-side-adjacent, independently burst-reactive packets, each containing, burst-releasably, a powdered flame-suppression agent, these packets collectively defining an inner side for the flame-suppression layer which is disposed, depending upon coating embodiment, either adjacent the outside face in the elastomeric-response layer, or adjacent the intumescence response layer's outside face.

10 Claims, 1 Drawing Sheet

Figure 1:
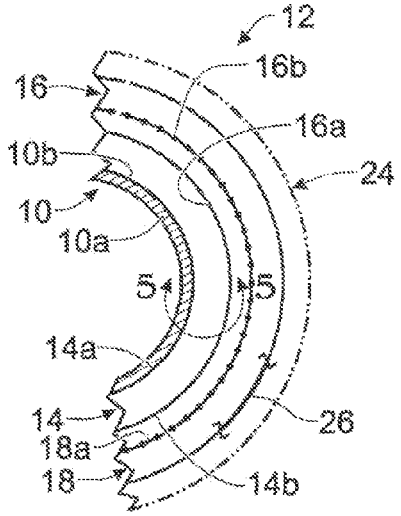

(51) Int. Cl.
*F41H 5/04* (2006.01)
*A62C 2/06* (2006.01)

(56) References Cited

U.S. PATENT DOCUMENTS

| | | | |
|---|---|---|---|
| 2,403,838 | A | 7/1946 | Wagner |
| 2,601,525 | A | 6/1952 | Howald et al. |
| 2,605,138 | A | 7/1952 | Paasche |
| 2,754,992 | A | 7/1956 | Wilson |
| 2,802,763 | A | 8/1957 | Freedlander |
| 3,431,818 | A | 3/1969 | King |
| 3,509,016 | A | 4/1970 | Underwood et al. |
| 3,606,154 | A | 9/1971 | Tufts |
| 3,645,834 | A | 2/1972 | McCaffrey |
| 3,664,904 | A | 5/1972 | Cook |
| 3,676,197 | A | 7/1972 | Harrison et al. |
| 3,698,587 | A | 10/1972 | Baker et al. |
| 3,772,071 | A | 11/1973 | Harr |
| 3,801,425 | A | 4/1974 | Cook |
| 3,830,261 | A | 8/1974 | Hochberg et al. |
| 4,083,318 | A | 4/1978 | Verolme |
| 4,115,616 | A | 9/1978 | Heitz et al. |
| 4,197,092 | A | 4/1980 | Bretz |
| 4,216,803 | A | 8/1980 | Hall |
| 4,345,698 | A | 8/1982 | Villemain |
| 4,352,851 | A | 10/1982 | Heitz et al. |
| 4,422,561 | A | 12/1983 | Grosvenor et al. |
| 4,467,015 | A | 8/1984 | Clem |
| 4,529,656 | A | 7/1985 | Haigh et al. |
| 4,728,711 | A | 3/1988 | Rosthauser et al. |
| 4,783,340 | A | 11/1988 | McDonell et al. |
| 4,799,454 | A | 1/1989 | Ito |
| 4,808,042 | A | 2/1989 | Muehlberger et al. |
| 5,250,650 | A | 10/1993 | Boretzky et al. |
| 5,306,557 | A | 4/1994 | Madison |
| 5,306,867 | A | 4/1994 | Connole et al. |
| 5,383,567 | A | 1/1995 | Sorathia et al. |
| 5,463,791 | A | 11/1995 | Roden |
| 5,472,743 | A | 12/1995 | Daluise |
| 5,691,410 | A | 11/1997 | Escarsega et al. |
| 5,853,215 | A | 12/1998 | Lowery |
| 6,040,356 | A | 3/2000 | Kanki et al. |
| 6,103,641 | A | 8/2000 | Gehring, Jr. |
| 6,358,580 | B1 | 3/2002 | Mang et al. |
| 6,432,882 | B1 | 8/2002 | Yamamoto |
| 6,803,400 | B1 | 10/2004 | Butterbach et al. |
| 7,169,452 | B1 | 1/2007 | Monk et al. |
| 7,220,455 | B2 | 5/2007 | Bennett et al. |
| 7,229,673 | B1 | 6/2007 | Monk et al. |
| 7,381,287 | B2 | 6/2008 | Monk et al. |
| 7,393,572 | B1 | 7/2008 | Monk et al. |
| 7,614,347 | B2 | 11/2009 | Ohnstad et al. |
| 7,678,453 | B2 | 3/2010 | Ohnstad et al. |
| 7,732,028 | B2 | 6/2010 | Monk et al. |
| 7,785,670 | B2 | 8/2010 | Ohnstad et al. |
| 7,854,968 | B2 | 12/2010 | Ohnstad et al. |
| 7,901,750 | B2 | 3/2011 | Atwood et al. |
| 7,905,296 | B2 * | 3/2011 | Bennett ..... 169/46 |
| 8,043,676 | B2 | 10/2011 | Ohnstad et al. |
| 2002/0124785 | A1 | 9/2002 | Robinson |
| 2004/0065456 | A1 | 4/2004 | Belli et al. |
| 2004/0231703 | A1 | 11/2004 | McCormick et al. |
| 2005/0084334 | A1 | 4/2005 | Shi et al. |
| 2005/0100667 | A1 | 5/2005 | Mayer et al. |
| 2005/0202181 | A1 | 9/2005 | Grossmann et al. |
| 2006/0121245 | A1 | 6/2006 | Lasson |
| 2006/0269680 | A1 | 11/2006 | Bennett et al. |
| 2007/0224401 | A1 | 9/2007 | Telander |
| 2008/0006146 | A1 | 1/2008 | Magnusson et al. |
| 2008/0076312 | A1 | 3/2008 | Gehring |
| 2009/0004433 | A1 | 1/2009 | Privitera et al. |
| 2009/0239064 | A1 | 9/2009 | Ohnstad et al. |
| 2009/0239436 | A1 | 9/2009 | Ohnstad et al. |
| 2010/0285247 | A1 | 11/2010 | Monk et al. |
| 2011/0253726 | A1 | 10/2011 | Monk et al. |
| 2011/0272418 | A1 | 11/2011 | Ohnstad et al. |
| 2012/0055937 | A1 | 3/2012 | Monk et al. |
| 2012/0058318 | A1 | 3/2012 | Monk et al. |
| 2012/0058348 | A1 | 3/2012 | Monk et al. |
| 2012/0058700 | A1 | 3/2012 | Ohnstad et al. |
| 2012/0152100 | A1 | 6/2012 | Petrovich et al. |

* cited by examiner

PLURAL LAYER, PLURAL-ACTION PROTECTIVE COATING FOR LIQUID FUEL CONTAINER

CROSS-REFERENCE TO RELATED APPLICATION

This application claims filing date priority to U.S. Provisional Patent Application Ser. No. 61/567,111, filed Dec. 5, 2011 for "Triple-Protection Tank Adder", the entirety of which is hereby incorporated herein by reference.

BACKGROUND AND SUMMARY OF THE INVENTION

The present invention pertains to a specialized, defensive coating, or coating structure, applicable to the outside of a fuel container, such as to the outside of a fuel tank or a fuel pipeline, to mitigate and fend off certain kinds of potential catastrophic fire and explosion events. More particularly, it relates to a plural-layer, plural-action (anti-fuel-leak, anti-shockwave, and additionally, with regard to one preferred embodiment, anti-fireball, and anti-"pool-fire") protective coating for such a container.

To meet these objectives, the proposed coating possesses, differentially in its two, different, preferred embodiments, different overall category, plural, intentionally differentiated-defense, coating-layer features that are designed to guard specifically against container-attack-promoted, ignited-liquid-fuel contribution to, or initiation of, a catastrophic, consequential fire, and/or a container-explosion—such prospectively dangerous events resulting, for example, from an attack, such as a bullet or shrapnel penetration, or, respecting one of the preferred, added-protection embodiments of the invention, a close-by explosive weapon blast of the kind typically characterized by an initial, extremely high-pressure shock wave, followed almost immediately by an intense, blast-produced fireball, and thereafter by a high-heat-intensity, proximate "pool-fire" (a military term of art).

Threats of a consequential, fuel-container catastrophe triggered by container attacks such as those just mentioned are common potentials in military-action theaters, and similar threats, we have recognized in the conception and reduction to practice of the present invention, may also exist in other kinds of danger-prone situations.

In relation to these kinds of potential-catastrophe settings, an overall purpose of the present invention, accordingly, is to safeguard personnel and equipment from the harmful consequences of such attacks through minimizing, in several different ways which differentially address the different kinds of potential attacks, such as those kinds of attacks mentioned above, the likelihood of a successful, attack-induced, uncontrolled container rupture, container fuel leak, fuel ignition, and possible fuel-container explosion.

While there are disclosed herein several modified forms of the coating structure of the present invention, fundamentally there are two, key, or principal, preferred embodiments of the invention, one of which includes, and the other of which does not include, what is referred to herein as an intumescence-response layer. The presence or absence of this layer determines, for the respective, associated coating, the range of different defensive/protective options made available by the coating. With regard to these two principal embodiments, which, accordingly, form preferred embodiments for uses in somewhat different settings and applications as will be explained below, except for the presence or absence of an intumescence-response layer, in all other respects these two embodiments are substantially identical in construction. Modifications that are described regarding other facets of the invention are applied essentially equally to each of these two, different, key embodiments.

The present invention, in one of its preferred embodiments, and specifically that embodiment which offers the largest range of defenses to different, possible, container-attack problems, features a plural-layer, plural-action, protective coating for a liquid fuel-container, placeable adjacent the outside surface of such a container, designed to furnish differentiated defenses to attacks like those identified above—with this coating possessing:

(1) a self-sealing, anti-fuel-leakage, elastomeric-response layer having and inside face disposable directly and contactively adjacent such a liquid fuel container's outside surface, and an outside face spaced from its inside face;

(2) an intumescence-response layer having an inside face disposed operatively adjacent the outside face in the elastomeric-response layer, formed of an intumescence putty material, and having an outside face; and (3) a packetized, burst-reactive, flame-suppression layer including plural, side-by-side-adjacent, independently burst-reactive packets each containing, burst-releasably, a powdered, flame-suppression agent, these packets collectively defining an inner side for the flame-suppression layer disposed adjacent the intumescence-response layer's outside face.

Preferably, the burst-reactive packets are generally planar, flexible, characterized with hexagonal perimeters having packet edges, and disposed in an appropriate, side-by-side tiled, and hexagonal packet-edge adjacency fashion, in the flame-suppression layer. As will be explained, each of these packets is formed herein from a stacked arrangement of plural, relatively thin but same perimetral outline, subpackets fundamentally made of what is known in the art as a very flexible, three-dimensional spatial fabric material—this material being defined, per se, by a pair of spaced, facial fabric sheets that are interconnected by a tangled collection of slender, nonlinear, wandering fibres which meander in and through a surrounding void space extant between the spatial-fabric facial sheets. Stacking of these subpackets conveniently accommodates construction of a flexible, assembled hexagonal, or hex, packet having the desired overall thickness.

Uniquely with respect to the packetized construction of the flame-suppression layer, if damage occurs to a packet, or packets, in this layer, as, for example, by an inadvertent contact-breakage of one or more packet(s), or by a projectile penetration, or penetrations, the damaged packet(s) may easily be replaced so as to "repair" the functional integrity of the layer for its intended defensive purpose.

The self-sealing, anti-fuel-leakage, elastomeric-response layer employed is plural-sublayer in nature, and includes inner, intermediate and outer sublayers each formed, commonly, with a main body of a high-elastomeric, liquid-fuel-reactive material, with an augmentation included in the intermediate sublayer in the form of a population of plural, distributed, liquid-fuel-imbiber beads embedded in the intermediate sublayer's main, high-elastomeric body.

Also included in this embodiment of the invention, as well as in all other embodiments and applications wherein the outermost, protective layer takes the form of the mentioned, packetized, burst-reactive flame-suppression layer, is a relatively thin (typically with a thickness lying in the range extending from about 0.06- to about 0.08-inches), appropriately sprayed-on, surrounding "capture jacket" of the same high-elastomeric material which has been mentioned above herein, applied over the packets in the flame-suppression layer to stabilize their attachments (contact adhesive bonds) to the immediately underlying coating protective layer.

According to one modified form of the invention, the proposed coating includes yet another, extra, anti-fuel-leakage, protective layer which is disposed as an overall, outside layer applied to surround all of the other layers in the coating—this extra, outer layer being like the "more internal", plural-sub-layer, liquid-fuel-reactive, high-elastomeric material layer mentioned above.

The other, principal, preferred embodiment of the invention, and specifically that embodiment which offers a somewhat reduced range of defenses to different, potential, container-attack problems, also features, generally speaking, a plural-layer, plural-action, protective coating for a liquid fuel-container, placeable adjacent the outside surface of such a container, designed to furnish differentiated defenses to certain ones of the attacks identified above—this coating embodiment lacking an intumescence-response layer, but nonetheless possessing:

(1) a self-sealing, anti-fuel-leakage, elastomeric-response layer having an inside face disposable directly and contactively adjacent such a liquid fuel container's outside surface, and an outside face spaced from its inside face; and (2) a packetized, burst-reactive, flame-suppression layer including plural, side-by-side-adjacent, independently burst-reactive packets, each containing, burst-releasably, a powdered, flame-suppression agent these packets collectively defining an inner side for the flame-suppression layer disposed adjacent the elastomeric response layer's outside face.

As mentioned earlier, this embodiment of the invention differs from the first, above-described, principal embodiment only by the absence in it of the intumescence-response layer. It is especially useful in applications wherein both minimizing coating weight is important, and there is little anticipated threat of a "pool-fire" incident, or the like.

Regarding all forms of the invention, included among the materials that are preferably employed herein to form the different layers in the proposed coating are (1) a high-elastomeric, liquid-fuel reactive elastomer material (as mentioned above), (2) liquid-fuel-imbiber beads, (3) an intumescence putty material, (4) a three-dimensional spatial fabric, and (5), a powdered, flame-suppression agent. While there are various commercially available offerings of very adequate choices for such materials, we have selected the following, specific, respective materials which have been found to perform admirably in the coating of the present invention.

The liquid-fuel-reactive, high-elastomeric material employed herein takes the form of a two-component polyurethane elastomer product sold under the trademark TUFF STUFF® FR (with the letters FR standing for fire-resistant), made by Rhino Linings USA, Inc.—a company based in San Diego, Calif. This material, which is preferably sprayed into place, and which plays a key role in furnishing self-sealing, anti-fuel-leakage behavior in the coating of the invention, in addition to responding to, say, a bullet puncture wound with high-elastomericity wound-closure action, additionally reacts to contact with hydrocarbon fuel—imbibing such fuel, and swelling in the process to aid in wound closure performance. In relation to elastomericity, it exhibits an elasticity which permits an elastic elongation before "breakage" of about 400%, has a tensile strength of about 1700-1900-psi, and possesses a tear resistance of about 140-150-pli.

More information about this material, about how it may be applied and employed, and about how it responds/reacts to contact with leakage fuel coming from a puncture wound in an associated, protected fuel container, will be found in U.S. Pat. No. 7,169,452, the full disclosure content in which is hereby incorporated herein by reference The liquid-fuel-imbiber beads used herein preferably take the form of the imbiber-bead product known as IMB230300, made by Imbibitive Technologies America, Inc. in Midland, Mich. These beads have a strong affinity for rapidly absorbing (imbibing) hydrocarbon fuel, and they swell significantly and quickly in volume as a consequence—an action which cooperates with the surrounding, embedding, high-elastomer material in aid of speedy and definitive puncture-wound, anti-fuel-leakage closure. These beads preferably are blended in any appropriate manner into the entraining/embedding elastomer material to constitute about 20% by weight in the combined material.

The intumescence-response layer, when included in the overall defensive coating/layer structure of the invention, takes the form of any suitably, conventionally available, easily layer-applied, intumescence putty material. Many such conventional putty materials, all of which are entirely appropriate for use in the coating structure of the present invention, are readily commercially available. A good representative, intumescence putty product which we have found to be very satisfactory is one made by 3M, identified as 3M™ Fire Barrier Moldable Putty Pads MPP+ (Product Number MPP+ 4X8).

This intumescence putty material, as is understood by those generally skilled in the art, functions, in the presence of external heat, i.e., in the presence of a high-temperature, ambient condition such as that produced by a proximate, external fire, to swell with a kind of popcorn-like, popping action which releases water vapor in a manner which helps to isolate and protect, for a relatively long period of time, the protected, container-contained fuel from a dangerous temperature rise and potential fuel ignition/explosion. Preferably, the intumescence putty material is applied to form the intumescence-response layer in a fashion whereby it is captured, and stabilized by an embedded, open mesh fabric possessing open meshes, typically of about ½-inches in mesh size, made of a high-temperature, fibre/strand material, such as basalt. This mesh fabric is not specifically presented in the drawings herein in order to minimize unnecessary drawing clutter.

Regarding the burst-reactive, flame-suppression layer, a preferred three-dimensional fabric which is usable very effectively in the coating structure of the present invention to form the hexagonal packets mentioned above is a product made by Gehring Textile, Inc., Garden City, N.Y.—this product being identified as Product (or Part) #SHR705/60, Black, No. 9321. Various details of these packets will be discussed below, and as will be further explained, each packet employed herein is actually formed as an assembly with a user-selected plurality of facially-contact-adhesively bonded, generally planar, hexagonal subpackets, each with a thickness of about ¼-inches (see $D_2$ in FIG. 3). Preferred overall thickness of a "packet assembly of subpackets" lies in the range of about ½- to about 1-inches, and a 1-inch thickness, generally a good selection for many applications, is specifically chosen for illustration herein.

Each hexagonal packet herein has a dimension (measured between opposite, straight-linear sides, referred to herein as hexagonal packet edges) of about 6-inches (see $D_1$ in FIG. 2), and the hexagonal perimetral outlines of these packets readily and conveniently allow them to be placed in a grouped, hexagonally tiled fashion around the outside surface of a container in a manner readily accommodating different kinds of surface curvatures in a container.

The void spaces present in the individual hexagonal subpackets, as will further be explained below, are densely filled with a conventional, dry-chemical flame-suppression agent, such filling being performed herein conveniently via a gravity-filling technique through a not-yet-closed packet edge which has been purposely left open for this purpose. The agent used may be of any suitable type currently employed in dry-powder fire extinguishers, and the agent which we have specifically selected is the one known in the relevant art as Purple K. Purple K is currently considered to be the most effective dry chemical in fighting Class B (flammable liquid) fires, and can be used against some energized electrical equipment fires (USA Class C fires). It has about 4-5 times more effectiveness against class B fires than carbon dioxide, and more than twice that of sodium bicarbonate. Dry chemical powder works by directly inhibiting the chemical chain reaction which forms one of the four sides of the fire tetrahedron (Heat+Oxygen+Fuel+Chemical Chain Reaction=Fire). To a much smaller degree, a dry-powder agent also has a smothering effect which excludes oxygen from a fire.

The Purple-K powder agent is free-flowing, floatable on most liquids, non-abrasive, and does not wet with water. It has violet color, to distinguish it from other dry agents. Its principal component is potassium bicarbonate (78-82% by weight), with addition of sodium bicarbonate (12-15%), mica (1-3%), Fuller's earth (1-3%), amorphous silica (0.2-%), and is made hydrophobic by methyl hydrogen polysiloxane (0.2-1%).

In the structure of the present invention, the layers of the proposed protective coating coact effectively with one another in important ways, both independently and interdependently, to offer appreciable defenses against the kinds of dangerous events mentioned above. These differentiated-functionality protective layers, while cooperative both independently and interdependently, importantly are not cross-disabling relative to one another in many instances, in the sense that "defensive activation" of one in an intended, related defense mode, will not disable the still-defensive "posture" of the other layers.

The above-mentioned and other features and advantages that are offered by the invention will become more readily apparent and fully appreciated as the detailed description of the invention which follows below is read in conjunction with the accompanying drawings.

DESCRIPTIONS OF THE DRAWINGS

FIG. 1 presents a fragmentary, schematic, cross-sectional view of a liquid fuel container having a wall whose outside surface is protected, in accordance with the present invention, by a plural-layer, plural-action protective coating which has been suitably bonded to that surface. In this figure, the mentioned liquid fuel container is represented as possessing a generally cylindrical wall, and this might for example be characteristic of a liquid-fuel pipeline, or a liquid-fuel tank.

As will be described more fully below, FIG. 1 is employed, utilizing different illustration line qualities, to picture not only two, different, key, or principal, preferred embodiments of the invention, but also to show one modified invention form. More specifically, a solid, curvilinear line which appears in this drawing figure including a distribution of relatively evenly spaced, darkened dots represents the potential presence or absence, depending upon which of the two, key, preferred embodiments of the invention is involved, of the above-described, intumescence-response layer. With this dot-including line in place, such a defensive layer is included. If this same line is visualized as being absent, so also is the intumescence-response layer. As mentioned above, an intumescence-response layer may either be included or not included, depending upon which principal embodiment of the invention is to be employed in a particular, defense-requiring application.

Also appearing in FIG. 1 is an outer, large-diameter, dash-double-dot line which represents a modification wherein the coating of the invention includes an overall, cuter elastomeric-response layer.

Figure 2:
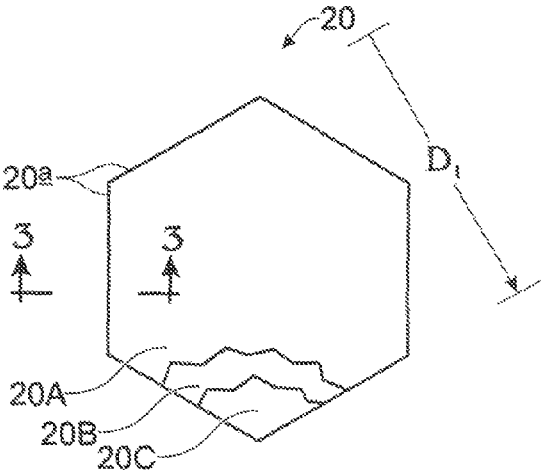

FIG. 2 illustrates, on a larger scale than that employed in FIG. 1, a plan-view illustration of a single stack assembly of generally planar (planarity existing essentially in and parallel to the plane of FIG. 2), flexible, inter-facially-adhered and united collection of four hexagonal subpackets which collectively make up a hexagonal burst-reactive packet that forms part of what is referred to herein as a packetized, burst-reactive, flame-suppression layer. Fragmentary portions of the subpacket stack which forms the illustrated packet have been removed to show all four subpackets in the stack.

Figure 3:
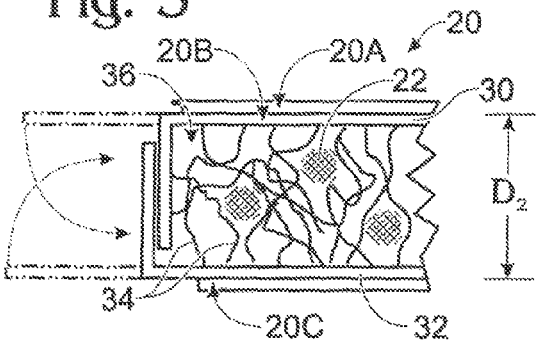

FIG. 3 is a fragmentary, cross-sectional view, taken generally along the line 3-3 in FIG. 2, drawn on a larger scale than that employed in FIG. 2, and illustrating, fragmentary, three of the four, total, hexagonal subpackets that are included in the subpacket stack which makes up the single, hexagonal packet pictured in FIG. 2. In this view, a centrally pictured subpacket has been broken open to illustrate certain details of its construction, including its pair of spaced, facial fabric sheets, interconnected by a tangled collection of slender, non-linear, wandering fibres which meander in and through a surrounding void space extant between the two facial sheets. Further, FIG. 3 includes certain dash-double-dot lines (linked with curvilinear arrows), associated with respectively related, and very evident, solid lines, presented to illustrate open and closed conditions for a subpacket edge, which conditions relate to accommodating the introduction into the subpacket's included central void space of a fill of powdered, flame-suppression agent in accordance with the invention. Small, "cross-hatch" shading appearing at three locations in the opened subpacket represents this fill of flame-suppression agent.

Figure 4:
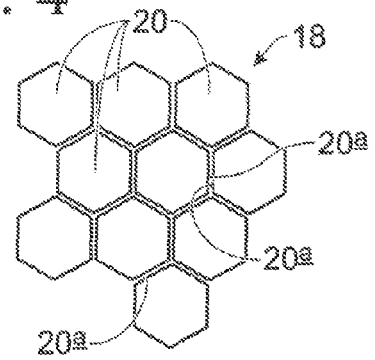

FIG. 4 is a reduced scale (considerably smaller than that employed in FIG. 2, but somewhat larger than that employed in FIG. 1), fragmentary, developed, plan view illustrating a portion of the packetized, burst-reactive, flame-suppression layer present in the coating of FIG. 1, and specifically showing a few of the hex packets of the present invention included in that layer, arranged, according to the invention, in a hexagonally tiled fashion to form the flame-suppression layer.

Figure 5:
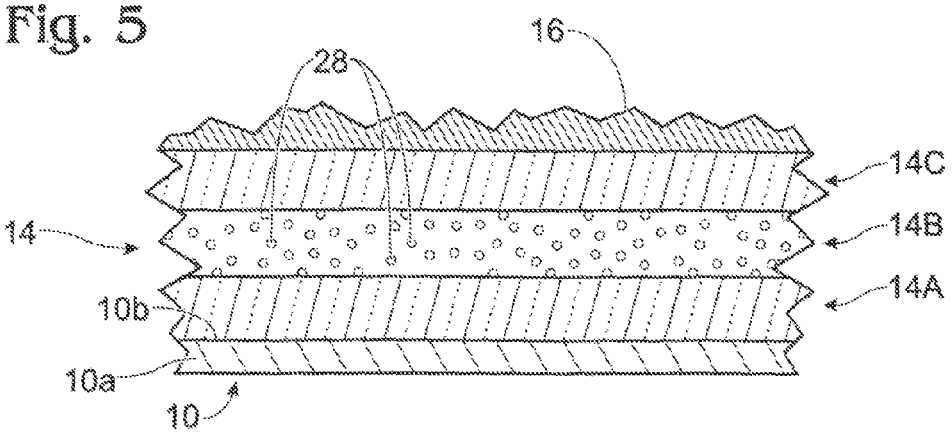

FIG. 5 is an enlarged, fragmentary, cross-sectional view, rotated approximately 90-degrees counterclockwise, taken generally in the area embraced by the double-arrow-headed, curved line 5-5 shown in FIG. 1—this view isolating and picturing a region of the coating structure of the present invention with particular emphasis given to the sublayer construction of an inner, self-ceiling, anti-fuel-leakage, elastomeric-response layer which is applied directly to the outside surface of the liquid-fuel-container wall shown in FIG. 1.

To be noted at this point is the fact, that the structural components pictured in the above-described drawing figures are not drawn to scale.

DETAILED DESCRIPTION OF THE INVENTION

Turning now to the drawings, and referring first of all to FIG. 1 indicated generally at 10 is a liquid fuel container having a cylindrical wall 10*a* which is generally cylindrical in construction, as mentioned earlier herein, in reference with respect to the description given above of FIG. 1—this wall possessing a cylindrical, outside surface 10*b*.

Applied, in a manner which will be more fully described below, to wall surface 10*b* is a plural-layer, plural-action, protective coating, or coating structure, 12 which is designed to furnish defensive protection relative to different ones of the several kinds of potential container-attacking events mentioned above herein. As indicated above, FIG. 1 is employed herein to illustrate a pair of key, principal, preferred embodiments of coating 12, and to show, additionally, a modified, extra-overall-outer-layer form of the invention which is applicable, where employed, to each of these two principal embodiments.

Describing, with appropriate lateral references made to FIGS. 2, 3 and 4, all of what is shown by the different line characters presented in FIG. 1, and explaining thereafter how this pictured structure is featured, respectively, in the mentioned, two, principal embodiments of the invention, and in the extra outside layer modification referred to, coating 12, in FIG. 1, is seen to include: (1) an inner, self-sealing, anti-fuel-leakage, elastomeric-response layer 14 having an inside face 14*a* disposed directly, contactively adjacent container surface 10*b*, and an outside face 14*b*; (2) an intumescence-response layer 16, formed of the above-identified intumescence putty material, and having and inside face 16*a* disposed adjacent, and appropriately adhesively bonded to, the outside face 14*b* in the elastomeric-response layer, and an outside face 16*b*; (3) a packetized, burst-reactive, flame-suppression layer 18, including plural, side-by-side-adjacent, tiled, independently burst-reactive packets, such as packets 20 (see FIGS. 2, 3 and 4), each containing, burst-releasably, a powdered, flame-suppression agent 22 (see especially FIG. 3), with this layer having an inner side 18*a*, defined collectively by the inner faces of packets 20, disposed adjacent the intumescence-response layer's outside face 16*b*; and (4), as a possible modification relevant to certain applications, an extra, overall, outside, elastomeric response layer 24 which has the same construction as elastomeric-response layer 14.

Layer 14 has a thickness herein of about 0.625-inches, layer 16, a thickness in the range of about 0.125-0.250-inches, layer 18, a thickness in the range of about 0.5-1.0-inches, with a preferred thickness of about 0.75-inches, and modification layer 24, when included, a thickness which is the same as that of layer 14.

Recalling that the presence or absence of intumescence-response layer 16 defines one or the other of the two, mentioned, principal embodiments of the invention, if one simply looks at FIG. 1 with the idea that layer 16, i.e. that layer whose outside perimeter is marked by the earlier mentioned curvilinear line which includes a distribution of darkened dots, the overall thickness of that version of coating 12 shrinks by the thickness of the no-longer-present intumescence-response layer, and the inner side of the packetized flame-suppression layer is, under this circumstance, bonded through an appropriate contact adhesive to the outside face in elastomeric-response layer 14.

Directing attention for a moment specifically to FIG. 5, here, as mentioned earlier, is a fragmentary illustration specifically featuring the construction of elastomeric-response layer 14. As can be seen, this layer possesses three sublayers, including an inner sublayer 14A, an intermediate sublayer 14B, and an outer sublayer 14C whose outer surface defines previously mentioned outside face 14*b* in layer 14. Each of these sublayers is formed with a main body of the above-described high-elastomeric, liquid-fuel-reactive, self-sealing material, and it is within intermediate sublayer 14B that there is included an embedded/entrained population of plural, distributed, liquid-fuel-imbiber-bead elements, such as those shown at 28, formed by the liquid-imbiber bead product described above herein.

While different, specific thicknesses may be selected for each of the sublayers in layer 14, herein, inner sublayer 14A has a thickness of about 0.3-inches, intermediate sublayer 14B, a thickness of about 0.125-inches, and outer sublayer 14C, a thickness of about 0.2-inches—thus giving layer 14, in an overall sense, the above-indicated total thickness of about 0.625-inches.

Focusing attention at this point specifically on FIGS. 2-4, inclusive, within flame-suppression layer 18, the individual, generally planar, hexagonal packets, 20, have the illustrated, and previously described, clearly evident hexagonal perimeters including six packet edges, such as the two such edges shown at 20*a* in FIG. 2. Within layer 18, and as has also been mentioned above herein, the flexible, hexagonal, burst-reactive packets which make up this layer are disposed in an appropriate, side-by-side tiled, and hexagonal packet-edge adjacency fashion, and this arrangement is made clearly evident in the fragmentary illustration of layer 18 which is shown in FIG. 4. Each packet in layer 18 is appropriately adhesively bonded to whatever, in accordance with which of the two, principal, preferred embodiments of coating structure 12 is involved, is the immediately underlying layer structure—namely, either elastomeric-response layer 14, or intumescence-response layer 16.

As can be seen particularly well in FIGS. 2 and 3, each burst-reactive packet 20 is formed as a stack assembly of three, flexible, generally planar subpackets, such as the three subpackets seen in FIG. 2 at 20A, 20B, 20C. These same, three subpackets are pictured elevationally, fragmentary, and in cross section in FIG. 3. Within each subpacket stack assembly that defines a hexagonal packet 20, the included individual subpackets are interfacially bonded to one another via a suitable contact adhesive. Each subpacket, as was mentioned earlier herein, has a thickness of about ¼-inches, giving each packet assembly the mentioned 0.75-inches thickness.

Directing attention particularly to FIG. 3 which furnishes a clear, internal illustration of a portion of an edge region in above-mentioned subpacket 20B, the three-dimensional spatial fabric which is employed here is seen to be characterized by a pair of spaced, flexible, facial fabric sheets 30, 32, that are interconnected by a tangled collection of slender, nonlinear, wandering fibres 34 that meander in and through a surrounding void space 38 which is extant between sheets 30, 32. It is within void space 36 that the previously mentioned flame-suppression powder agent, 22, is packed.

The linear edges in "finished", flame-suppression-agent-filled subpackets are overlappingly folded upon themselves, and adhesively bonded to one another, to close the subpackets, with one of these edges in each subpacket initially left open before final, full closure so as to permit gravity filling and packing of the included flame-suppression agent. Dash-double-dot lines, and a pair of curved arrows, in FIG. 3 illustrate this for a so left-open, and later closed, edge in subpacket 20B.

Not specifically a part of the defensive aspect of coating 12, and illustrated fragmentary by a short (fragmentary), curvilinear, darkened line 26 in FIG. 1, which line appears to coincide with the outside curvilinear configuration of flame-suppression layer 18, is a relatively thin (typically, as mentioned earlier herein, possessing a thickness lying in the range of about 0.06- to about 0.08-inches), appropriately sprayed-on, surrounding "capture jacket" formed of the same high-elastomeric material which has been mentioned above herein, applied over the packets in the flame-suppression layer to stabilize their attachments (contact adhesive bonds) to whatever is the immediately underlying coating protective layer. If a hex packet in layer 18 needs to be replaced for any reason, it is a simple matter to cut through the related capture-jacket overcoating to do this, with such packet replacement thereafter followed by simple, spray-restoration of whatever capture-jacket area requires rebuilding.

From what has been described above herein respecting the three, different kinds of protective and defensive layers, and the preferred materials that are employed in these layers, it will be readily apparent to those generally skilled in the relevant art how these layers furnish the types of defensive protections to attack events like those mentioned. It will also be apparent to those skilled in the art how the described and illustrated defensive layers in the coating of the invention offer not only cooperative, hut also independent, defensive capabilities. It will further be evident to those generally skilled in the art how it is the case that, in many instances, a defensive response mounted by one of the layers in the coating structure in relation to an attack may not necessarily be cross-disabling with respect to the defensive capabilities of the other layer, or layers, included in the coating.

For example, a projectile, such as a bullet or a piece of shrapnel, which passes through the coating layers and penetrates the wall in a protected fuel container will be responded to rapidly by the self-sealing reaction which occurs in the inner elastomeric-response layer. Such a reaction is as is fully described in the incorporated-herein-by-reference U.S. Pat. No. 7,169,452. Such a penetration wound, while certainly responsible for producing entry penetration wounds in the outer layer, or layers, will normally not defeat the defensive capabilities of those layers, except perhaps in the exact layer locations of the penetrating wound.

An explosive weapon blast attack involving a high-pressure shock wave, and an immediately following, high-heat-intensity fireball (and potential pool fire), will cause the hexagonal packets that are exposed to this event initially to burst, and, via such bursting, rapidly expel outwardly into the approaching, and next-arriving, blast fireball a cloud of the flame-suppressing agent which is contained in the hex packets that have burst. Thus, in relation to such an event, there is an immediate packet burst response which tends to suppress a fireball flame—an important action in rapidly minimizing the exposure of whatever is the underlying, second layer, and accordingly, the container and its contained fuel, to a severe, spiking temperature rise.

Almost immediately thereafter, i.e., after a hex-packet burst reaction as described, and in a circumstance where an intumescence-response layer is included in coating 12, and continuing with a discussion of coating response to the severe kind of blast event just mentioned, the temperature rise which naturally occurs is responded to by the intumescence putty material forming the next, inner layer, whereby, following flame suppression by the expelled powder material from the burst hex packets, the intumescence putty material responds in a conventional, intumescence swelling and water-vapor-releasing fashion to control, and reduce rapidly to safe levels, a temperature rise within container-contained fuel.

These both cooperative (where two types of responses are required) and independent (where only one is needed) defensive behaviors while, certainly compromising regions of the layers involved, do not necessarily damage remaining-areas' defensive capabilities.

As suggested above, the protective coating structure of the invention is readily applicable in a wide variety of settings—military and other.

We claim:

1. A plural-layer, plural-action, protective coating placeable adjacent the outside surface of a liquid fuel container comprising a self-sealing, anti-fuel-leakage, elastomeric-response layer having an inside face disposable directly and contactively adjacent such a liquid fuel container's outside surface, and an outside face spaced from its said inside face, an intumescence-response layer having an inside face disposed operatively adjacent said outside face in said elastomeric-response layer, formed of an intumescence putty material that swells as a result of exposure to heat, and having an outside face, and a packetized, burst-reactive, flame-suppression layer including plural, side-by-side-adjacent, independently burst-reactive packets, each containing, burst-releasably, a powdered, flame-suppression agent, said packets collectively defining an inner side for the flame-suppression layer disposed adjacent said intumescence-response layer's said outside face.

2. The coating of claim 1, wherein said packets are generally planar, flexible, characterized with hexagonal perimeters having packet edges, and disposed in an appropriate, side-by-side tiled, and hexagonal packet-edge adjacency fashion, in said flame-suppression layer.

3. The coating of claim 2, wherein said packets are formed of a three-dimensional spatial fabric defined by a pair of spaced facial fabric sheets interconnected by a tangled collection of slender, nonlinear, wandering fibres which meander in and through a surrounding void space extant between the spatial-fabric facial sheets.

4. The coating of claim 1, wherein said elastomeric-response layer includes inner, intermediate and outer sublayers each formed with a main body of an elastomeric, liquid-fuel-reactive material, with said intermediate sublayer possessing a population of plural, distributed, liquid-fuel-imbiber beads embedded in the intermediate sublayer's main, elastomeric body.

5. The coating of claim 1 which further includes a fourth layer disposed over the flame-suppression layer as an overall, outside layer in the coating, and formed of a liquid-fuel-reactive, high-elastomeric material.

6. The coating of claim 1, wherein the intumescence putty material comprises material that, when exposed to a proximate, external fire, expands through a popping action that releases water vapor.

7. The coating of claim 1, wherein the intumescence-response layer is adhesively bonded to the outside face of the elastomeric-response layer.

8. The coating of claim 1, wherein the intumescence putty material is captured and stabilized by an embedded, open mesh fabric.

9. The coating of claim 8, wherein the open mesh fabric includes open meshes having a mesh size of about ½-inch.

10. The coating of claim 8, wherein the open mesh fabric comprises a plurality of basalt strands.

* * * * *